US006792648B2

(12) United States Patent
Lee

(10) Patent No.: US 6,792,648 B2
(45) Date of Patent: Sep. 21, 2004

(54) FLOOR CLOTH FOR USE IN VACUUM CLEANER AND APPARATUS OF VACUUM CLEANER FOR ROTATABLY DRIVING THE FLOOR CLOTH

(75) Inventor: Byung-jo Lee, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 95 days.

(21) Appl. No.: 09/818,689

(22) Filed: Mar. 26, 2001

(65) Prior Publication Data

US 2001/0027586 A1 Oct. 11, 2001

(30) Foreign Application Priority Data

| | | |
|---|---|---|
| Mar. 28, 2000 | (KR) | 10-2000-0015908 |
| Oct. 27, 2000 | (KR) | 20-2000-0030084 |
| Oct. 27, 2000 | (KR) | 10-2000-0063479 |
| Feb. 27, 2001 | (KR) | 10-2001-0010140 |

(51) Int. Cl.[7] ..... A47L 9/04

(52) U.S. Cl. ..... 15/377; 15/384; 15/385; 15/389

(58) Field of Search ..... 15/377, 384, 385, 15/389, 391

(56) References Cited

U.S. PATENT DOCUMENTS

| | | | | |
|---|---|---|---|---|
| 1,901,670 A | * | 3/1933 | Riebel, Jr. et al. | 15/328 |
| 1,947,136 A | * | 2/1934 | Moorhead | 15/328 |

(List continued on next page.)

FOREIGN PATENT DOCUMENTS

| | | |
|---|---|---|
| CH | 165489 | 11/1933 |
| CH | 363135 | 7/1962 |
| DE | 198 39 505 A1 | 3/2000 |
| EP | 0 590 690 A2 | 4/1994 |
| EP | 0 590 690 A3 | 4/1994 |
| JP | 46-37721 | 12/1971 |
| JP | 55-54926 | 4/1980 |
| JP | 2-243129 | 9/1990 |
| JP | 05-023277 | 2/1993 |
| JP | 7-9473 | 2/1995 |
| JP | 10-248779 | 9/1998 |
| JP | 2000-060773 | 2/2000 |
| RU | 124081 | 11/1959 |
| RU | 2121807 C1 | 11/1998 |
| WO | WO 90/14039 | 11/1990 |

*Primary Examiner*—Theresa T. Snider
(74) *Attorney, Agent, or Firm*—Westman, Champlin & Kelly, P.A.

(57) ABSTRACT

A floor cloth employed in a suction assembly of a vacuum cleaner for cleaning impurities on a cleaning surface, and an apparatus of the vacuum cleaner for rotatably driving the floor cloth. The rotatable floor cloth driving apparatus includes a rotary member rotatably disposed on a lower end of the suction assembly for supporting the floor cloth, and a rotational driving portion on-off controlled by a manipulation of a driving switch for providing a rotational driving force for rotating the rotary member on on-state. Accordingly, while drawing in air and impurities, the vacuum cleaner can also remove impurities stuck on the cleaning surface with the floor cloth.

20 Claims, 9 Drawing Sheets

U.S. PATENT DOCUMENTS 3,314,099 A * 4/1967 Otto ..... 15/385
3,663,985 A * 5/1972 Burgoon ..... 15/377
3,761,991 A 10/1973 Moss ..... 15/209
3,797,065 A * 3/1974 Hughes ..... 15/385
3,823,516 A 7/1974 Christian ..... 51/358
3,978,541 A 9/1976 Gustafsson ..... 15/229
4,052,767 A * 10/1977 Dutcher ..... 15/377
4,142,334 A 3/1979 Kirsch et al. ..... 51/395
4,352,846 A 10/1982 Passler et al. ..... 428/105
4,447,930 A * 5/1984 Glenn et al. ..... 15/377
4,457,042 A * 7/1984 Jones et al. ..... 15/377
4,473,923 A * 10/1984 Neroni et al. ..... 15/377
4,598,440 A * 7/1986 Wilson ..... 15/385
4,611,365 A * 9/1986 Komatsu et al. ..... 15/377
4,654,924 A * 4/1987 Getz et al. ..... 15/377
4,715,087 A * 12/1987 Todd et al. ..... 15/385
4,996,737 A * 3/1991 Madru, Sr. ..... 15/377
5,054,156 A 10/1991 Watanabe et al. ..... 15/325
5,054,157 A * 10/1991 Werner et al. ..... 15/377
5,419,015 A 5/1995 Garcia ..... 15/228
5,896,618 A 4/1999 Woo et al. ..... 15/324
6,163,923 A * 12/2000 Hefter ..... 15/385
6,494,772 B1 * 12/2002 Barnes et al. ..... 15/385

* cited by examiner

FLOOR CLOTH FOR USE IN VACUUM CLEANER AND APPARATUS OF VACUUM CLEANER FOR ROTATABLY DRIVING THE FLOOR CLOTH

BACKGROUND OF THE INVENTION

1. Field of the Invention

The present invention relates to a vacuum cleaner, and more particularly to an apparatus for rotatably driving a floor cloth of a vacuum cleaner for performing a floor mopping in addition to a dust suctioning of the vacuum cleaner.

2. Description of the Related Art

Generally, a vacuum cleaner performs a dust removing process by drawing in external air with foreign substances with suction force of a fan motor, and filtering the foreign substances with a filter.

As shown in FIG. 1, such vacuum cleaner includes a dust collecting chamber (not shown) having a dust filter mounted at a front inner portion of a cleaner body 1, and a fan motor (not shown) formed at a rear portion of the cleaner body 1. Further, the vacuum cleaner includes a suction assembly 9 that is removably connected to a hose 3 connected to the dust collecting chamber of the cleaner body 1, a handle portion 5, and a plurality of extension pipes 7.

In the conventional vacuum cleaner constructed as above, as the fan motor is driven, the dust collecting chamber of the cleaner body 1 is subject to a negative pressure with respect to outer atmosphere. Accordingly, external air and foreign substances are drawn into the dust collecting chamber through the suction assembly 9, the extension pipe 7, and the hose 3. During this process, the foreign substances are filtered out by the filter (not shown), and the clear air is passed through the fan motor and discharged out through an exhaust grill (not shown) formed at a rear side of the cleaner body 1.

Undesignated reference numeral 6 refers to a driving switch for on-off controlling the cleaner.

Although such vacuum cleaner can clean a pile of dust on a cleaning surface to some extent, there still is a shortcoming in that the vacuum cleaner cannot be useful when cleaning dirt or foreign substances stuck on the cleaning surface. Accordingly, for cleaning the dirt or foreign substances stuck on the surface, it takes a considerable time and separate labor.

SUMMARY OF THE INVENTION

The present invention has been made to overcome the above-mentioned problems of the related art, and accordingly, it is an object of the present invention to provide a floor cloth for use in a vacuum cleaner having an improved structure for mopping a floor by rotatably driving a floor cloth separately mounted on a suction portion of the vacuum cleaner, and an apparatus of the vacuum cleaner for rotatably driving the floor cloth.

In order to accomplish the above object, in an apparatus for rotatably driving a floor cloth employed in a suction assembly of a vacuum cleaner that draws in and collects air and dust in a dust collecting chamber through an air path connecting a suction assembly to a connecting pipe by a negative pressure generated by an operation of a driving portion that is activated by manipulating a driving switch of a handle portion, the apparatus according to the present invention includes a rotary member rotatably disposed on a lower end of the suction assembly, for supporting the floor cloth cleaning a cleaning surface; rotary driving means on-off controlled by the manipulation of the driving switch, for supplying a driving force for rotating the rotary member in an on-state; and power supplying means for supplying an electric signal from the manipulation of the driving switch to the rotary driving means.

Here, the rotary driving means includes a bi-directional rotary motor having a pair of rotary shaft portions formed on both sides of the rotary motor and simultaneously rotated with each other by the power supplied from the power supplying means, and a power transmission unit disposed for transmitting the driving force of the rotary shaft portions to the rotary member.

The power transmission unit includes a pair of worm gear members connected to the rotary shaft portions for being rotated in the same direction as the rotary shaft portions are rotated; and transmission gears meshed with the pair of worm gear members for converting a rotational force of the worm gear members into a perpendicular direction and transmitting the converted rotational force to the rotary member.

In order to accomplish another object, in a floor cloth removably employed in a mounting portion at a lower end of a suction assembly of a vacuum cleaner, the floor cloth for mopping impurities on a cleaning surface according to the present invention includes a body contacting the cleaning floor; a removable layer attached to an upper surface of the body, supportable by a binding force with removable means formed on the mounting portion; and supporting means for improving cleaning efficiency by preventing deformation of the body and enabling easier contact against the cleaning surface, when the body contacts the cleaning surface.

The supporting means includes a supporting member disposed between the body and the removable layer, for recovering the body into an original shape, elastically.

It is also preferable that the supporting means includes a protruding pattern protruding from a lower surface of the body contacting the cleaning surface in a predetermined pattern.

BRIEF DESCRIPTION OF THE DRAWINGS

The above object and other features of the present invention will be clarified by the following description with the attached drawings, in which.

DETAILED DESCRIPTION OF THE PREFERRED EMBODIMENT

Figure 1:
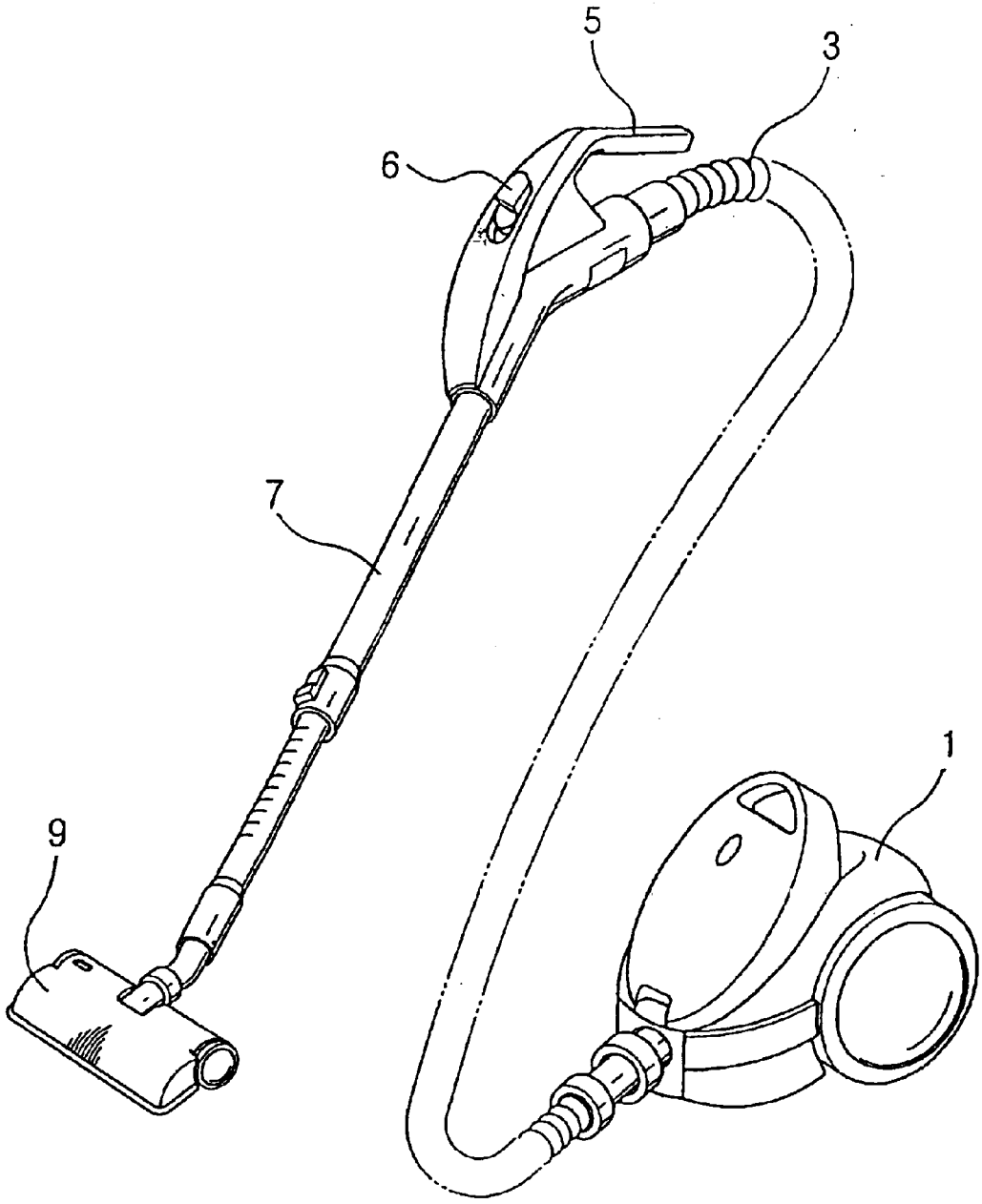
FIG. 1 (Prior Art)
FIG. 1 is a schematic perspective view of a conventional vacuum cleaner.

This invention will be described in further detail by way of example with reference to the attached drawings. Throughout the description, the like elements will be given the same reference numerals while repetitious description will be omitted as much as possible.

Figure 2:
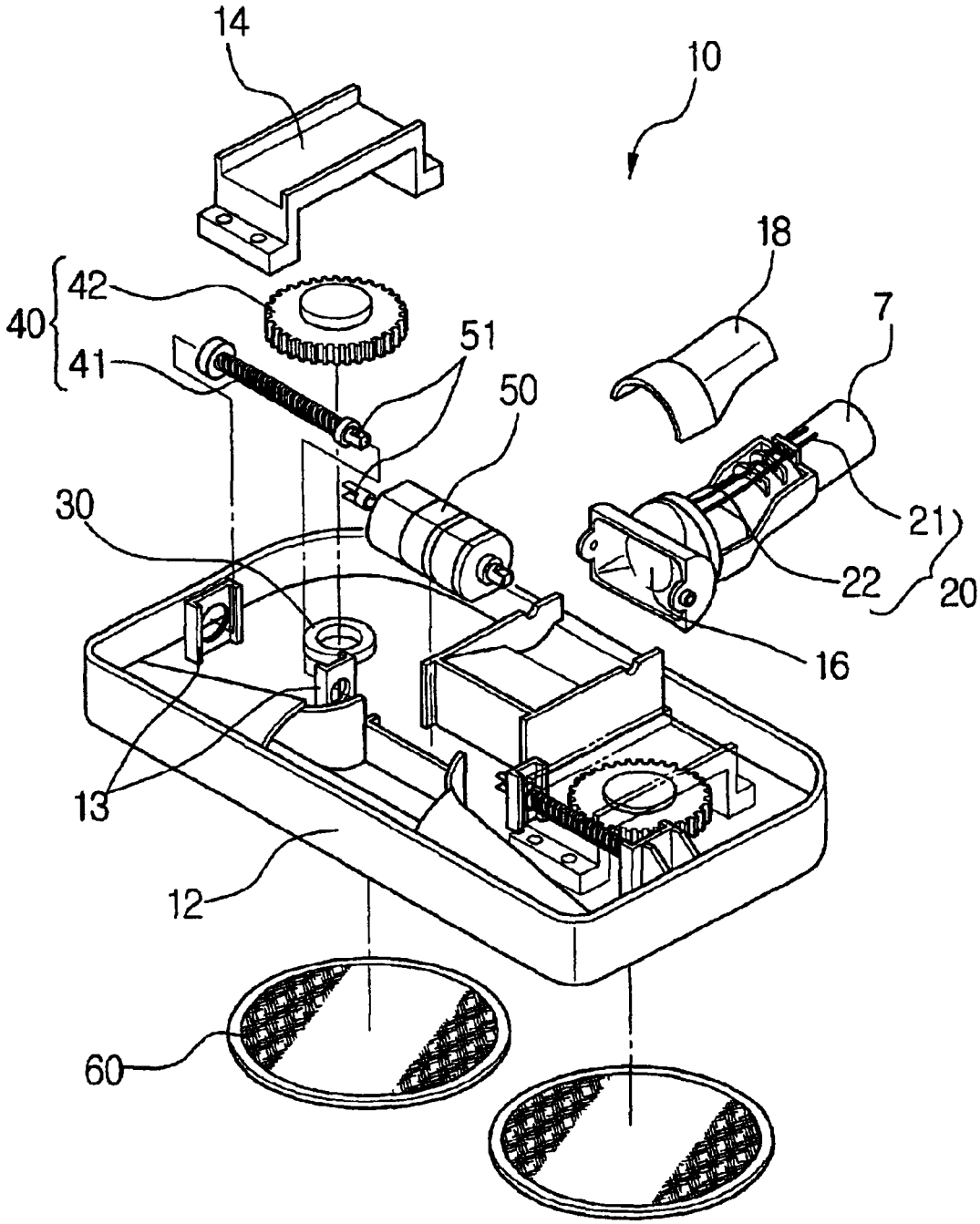
FIG. 2 is an exploded perspective view of a rotatable floor cloth driving apparatus of a vacuum cleaner according to a first preferred embodiment of the present invention.
Figure 3:
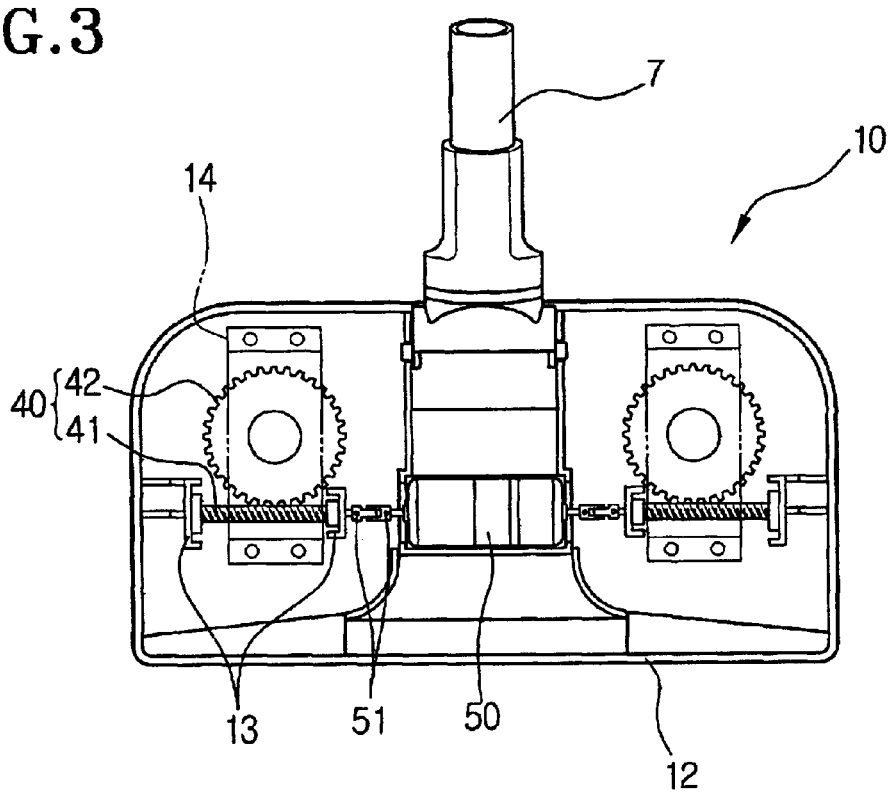
FIG. 3 is a plan view showing the structure of the rotatable floor cloth driving apparatus of FIG. 2 being assembled.
Figure 4:
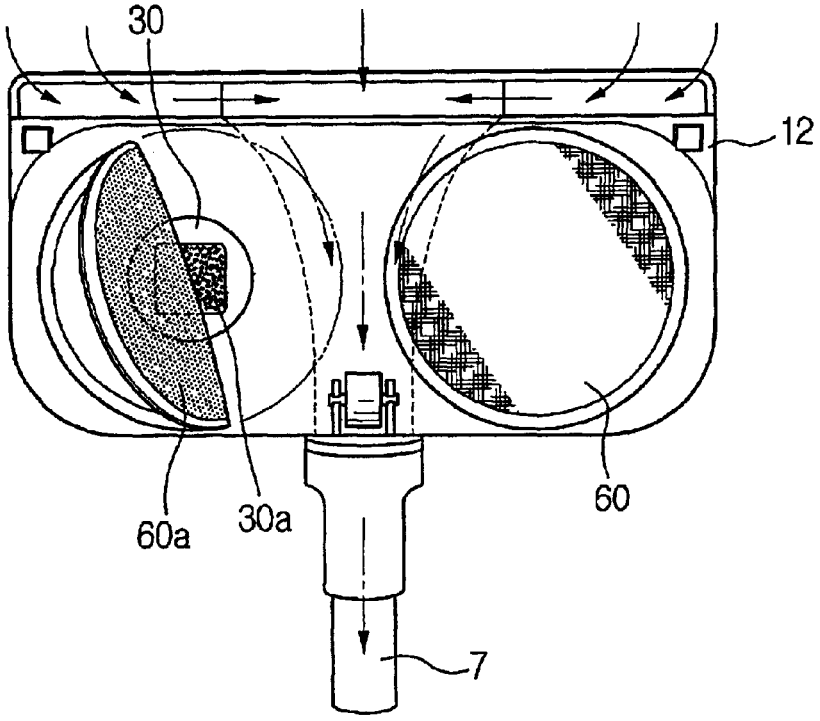
FIG. 4 is a bottom view of a suction assembly of a vacuum cleaner according to the first preferred embodiment of the present invention.

As shown in FIGS. 2 through 4, the rotatable floor cloth driving apparatus according to the first preferred embodiment of the present invention includes a pair of rotary members 30 rotatably disposed on a lower portion of a suction port body 12 of the suction assembly 10 of the vacuum cleaner for supporting a pair of floor clothes 60, respectively, a rotation driving means controlled through a manipulation of a driving switch 6 formed on a handle portion 5 (see FIG. 1) with an activated state and deactivated state for providing a driving force for rotating the rotary members 30, and a power supplying means 20 for supplying an electric signal from the manipulation of the driving switch 6 to the rotation driving means.

The power supplying means 20 is formed on the extension pipe 7 near the suction assembly 10, in a space separately defined by a protective cover 18 that screens the power supplying means 20 from an air path inclusive of the suction port 16. The power supplying means 20 is disposed in the space, and includes a power terminal 21 electrically connected to the driving switch 6 of the handle portion 5 and a power conductor 22 for electrically connecting the power terminal 21 with the rotation driving means.

The rotation driving means of the suction port body 12 includes a bi-directional rotary motor 50 having a pair of rotary shafts simultaneously rotated by the power supplied through the power terminal 21 and the power conductor 20 in an opposite direction, and a power transmission unit 40 connected to the pair of rotary shafts of the bi-directional rotary motor 50, respectively.

The power transmission unit 40 includes a pair of worm gear members 41 that are simultaneously rotated together with the rotation of the bi-directional rotary motor 50, and a pair of transmission gears 42 engaged with the pair of worm gear members 41 and rotated in a perpendicular direction with respect to the rotation of the pair of worm gear members 41.

The pair of rotary members 30 are mounted on the lower portions of the transmission gears 42 for transmitting the rotational force from the rotational movement of the bi-directional rotary motor 50 to the floor clothes 60. The rotary members 30 pass through the bottom surface of the suction port body 12 from the lower side of the suction port body 12, and connect to the transmission gears 42.

Meanwhile, the ends of the rotary shafts of the bi-directional rotary motor 50 are connected with the ends of worm gear members 41 by a pair of joint connecting members 51 disposed therebetween, while unconnected ends of the worm gear members 41 are rotatably inserted in holes of fixing brackets 13, respectively.

For cleaning the impurities on a cleaning surface more efficiently, it is preferable that the floor clothes 60 mounted on the rotary members 30 are rotated in opposite directions. Accordingly, it is preferable that the threads are formed on an outer circumference of the worm gear members 41 in an opposite direction, and the transmitting gears 42 are rotated in the opposite direction during the operation of the bi-directional rotary motor 50.

A protective cover 14 protects the power transmission unit 40.

The undesignated reference numeral 14 refers to a protective cover for protecting the power transmission unit 40.

Meanwhile, as shown in FIG. 4, removing means 30*a* is provided on the lower ends of the pair of rotary members 30, respectively, for removably connecting the floor clothes 60. It is preferable that the removing means 30*a* is a fabric fastening member such as a Velcro® (hook and loop) fastener. Removable fabric layers 60*a* are uniformly formed on the upper surfaces of the floor clothes 60 that contact the rotary members 30, 50 that the floor clothes 60 can be attached and removed to/from the removing means 30*a*. It is preferable that the removing layer 60*a* is formed of a fabric that corresponds to the Velcro® (hook and loop) fasteners 30*a*.

Figure 5:
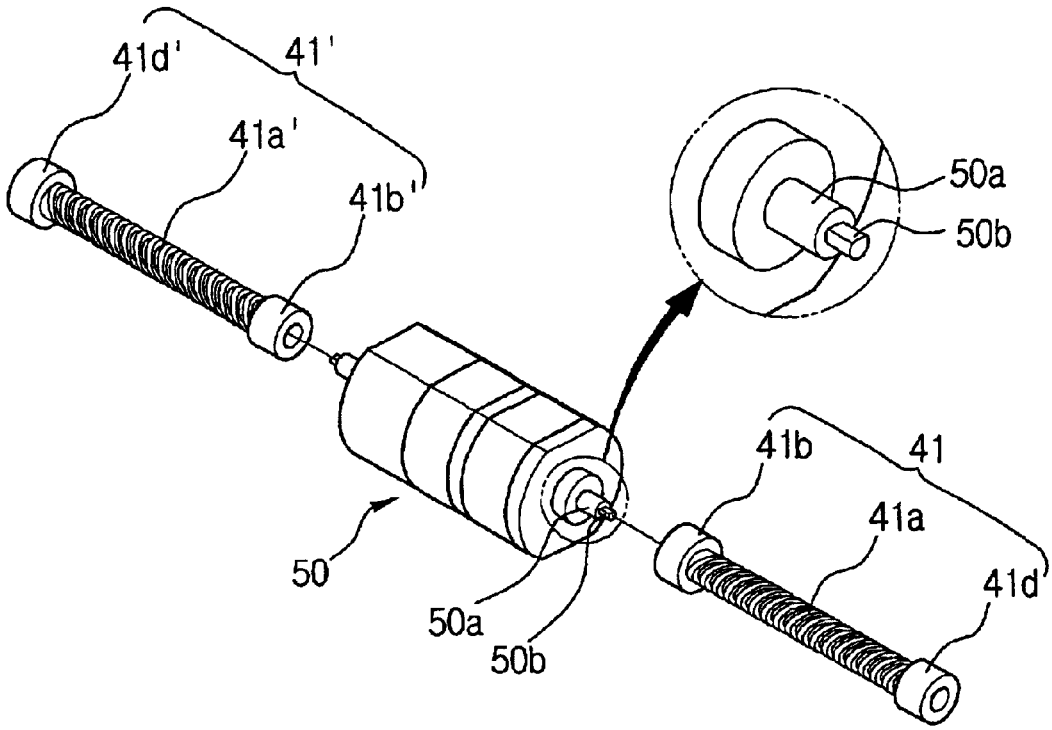
FIG. 5 is a perspective view showing the main portion of the suction assembly of the vacuum cleaner according to a second preferred embodiment of the present invention.
Figure 6:
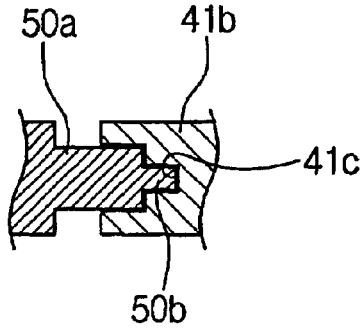
FIG. 6 is an enlarged sectional view showing the connecting portion of FIG. 5 being connected.

According to the second preferred embodiment of the present invention the rotation driving means includes rotary motor 50 (in FIGS. 2 and 3) and power transmission unit 40 (in FIGS. 2 and 3). The power transmission unit 40 includes a transmission gear 42 (in FIGS. 2 and 3) connected to the rotary members 30 (in FIG. 2). As shown in FIGS. 5 and 6, worm gear members 41 and 41' having worm gear portions 41*a* and 41*a*' formed on the outer circumference of the worm gear members 41 and 41' and engage with the transmission gears 42 (in FIG. 2), and connecting portions 41*b* and 41*b*' formed on respective ends of the worm gear members 41 and 41' an connected with the rotary shaft portions 50*a* and the bi-directional rotary motor 50 in a keyway.

The connecting portions 41*b* and 41*b*' of the worm gear members 41 and 41' are rotatably inserted in the fixing brackets 13 in FIG. 2 at the inner side of the suction port body 12, and then connected to the rotary shaft portions 50*a* of the rotary motor 50.

Here, as shown in FIGS. 5 and 6, the rotary shaft portions 50*a* have key portions 50*b* formed at ends of the rotary shaft portions 50*a*, while the connecting portions 41*b* and 41*b*' of the worm gear members 41 and 41' corresponding to the rotary shaft portions 50*a* have key grooves 41*c* and 41*c*' corresponding to the key portions 50*b*. The key portions 50*b* are such formed that the section of the key portions 50*b* are non-circular. Accordingly, the key portions 50*b* are inserted in the key grooves 41*c* and 41*c*'.

Accordingly, as the rotary shaft portions 50*a* of the rotary motor 50 are rotated, the key portions 50*b* are connected with the key grooves 41*c* and 41*c*' in a keyway, and the rotational force is transmitted to the worm gear members 41 and 41'.

Further, albeit not shown, the key portions 50*b* and the key grooves 41*c* and 41*c*' may have various configurations. Also, the key portions 50*b* can be formed on the worm gear members 41 and 41', while the key grooves 41*c* and 41*c*' are formed on ends of the rotary shaft portions 50*a*.

Meanwhile, it is preferable bearing members 41*d* and 41*d*' are provided to rotatably connect the unconnected ends of the worm gear members 41 and 41', which are unconnected with the rotary motor 50, with the fixing brackets 13 of the suction port body 12.

Compared to the general connecting methods, such as connecting member 51 (see FIG. 2), connecting the rotary shaft portions 43*b* with the key portions 41*b* and 41*b*' in a keyway can reduce the power loss during the power transmission from the rotary motor 50 to the gear members 41 and 41', and thus simplify and reduce the manufacturing process and cost.

Figure 7:
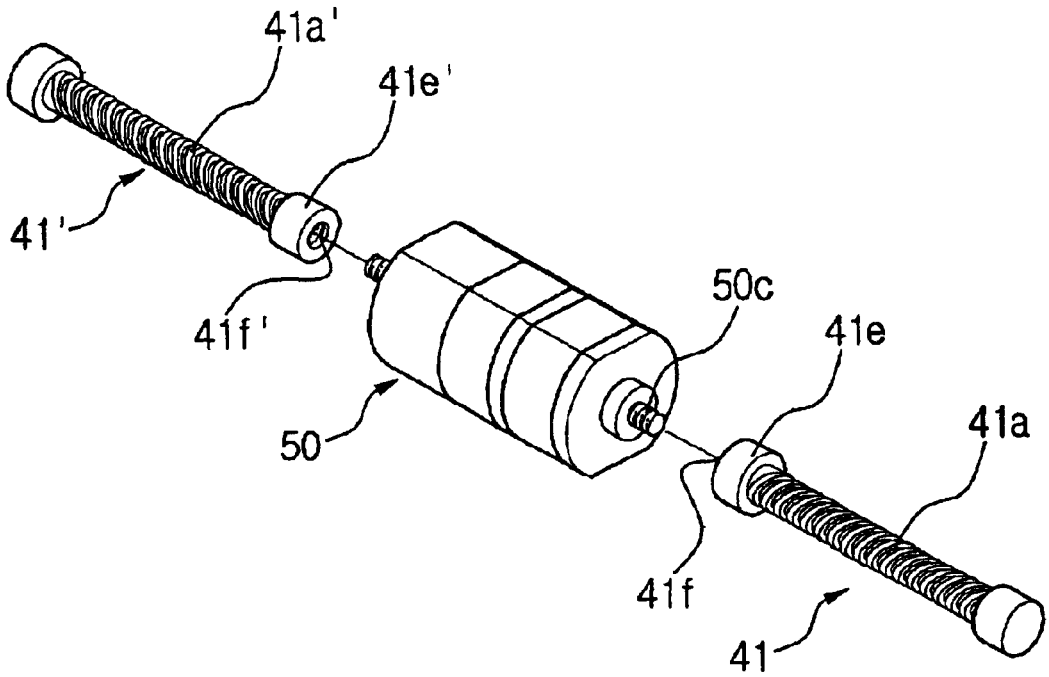
FIG. 7 is a perspective view showing the main portion of the rotatable floor cloth driving apparatus according to a third preferred embodiment of the present invention.

FIG. 7 shows the rotatable floor cloth driving means according to the third preferred embodiment of the present invention, including bi-directional rotary motor 50 and a power transmission unit 40. The power transmission unit 40 includes worm gear members 41 and 41' that have worm gear portions 41*a* and 41*a*' formed on the outer circumference of the worm gear members 41 and 41' and engaged with the transmission gears 42, and connecting portions 41*e* and 41*e*' formed on respective ends of the worm gear members 41 and 41' and screwed to the rotary shaft portions 50*c* of the rotary motor 50.

Here, the screw connection is made by forming male threads on the outer circumference of either the rotary shaft portions 50*c* or the connecting portions 41*e* and 41*e*' and forming corresponding female threads on the ends of either the connecting portions 41*e* and 41*e*' or the rotary shaft potions 50*c*.

In this embodiment, the male threads are formed on the outer circumference of the rotary shaft portions 50*c*, while the corresponding female threads are formed on mount portions 41*f* and 41*f*' of the connecting portions 41*e* and 41*e*' for partially receiving the rotary shaft portions 50*c*. It is also possible that the mount portions are formed on the rotary shaft portions 50*c* having female threads formed thereon, while the male threads are formed on the outer circumference of the connecting portions 41*e* and 41*e*'.

Meanwhile, when the rotary shaft portions 50*c* are rotated clockwise on the center of rotation, the threads formed on the connecting portions 41*e* and 41*e*' and the rotary shaft portions 50*c* are left-hand threads for screw fastening purpose. When the rotary shaft portion 50*c* are rotated counterclockwise on the center of rotation, the threads of the connecting portions 41*e* and 41*e*' and the rotary shaft portions 50*c* are right-hand threads.

As described above, by the screw fastening of the worm gear members 41 and 41' and the rotary shaft portions 50*c*, the secure connection is ensured, while the number of parts is reduced. Accordingly, the rotational driving force generated from the bi-directional rotary motor 50 is transmitted to the rotary members 30 with the least power loss. Further, thanks to reduced number of parts, the manufacturing process becomes simplified, while the manufacturing cost is considerably reduced.

Figure 8:
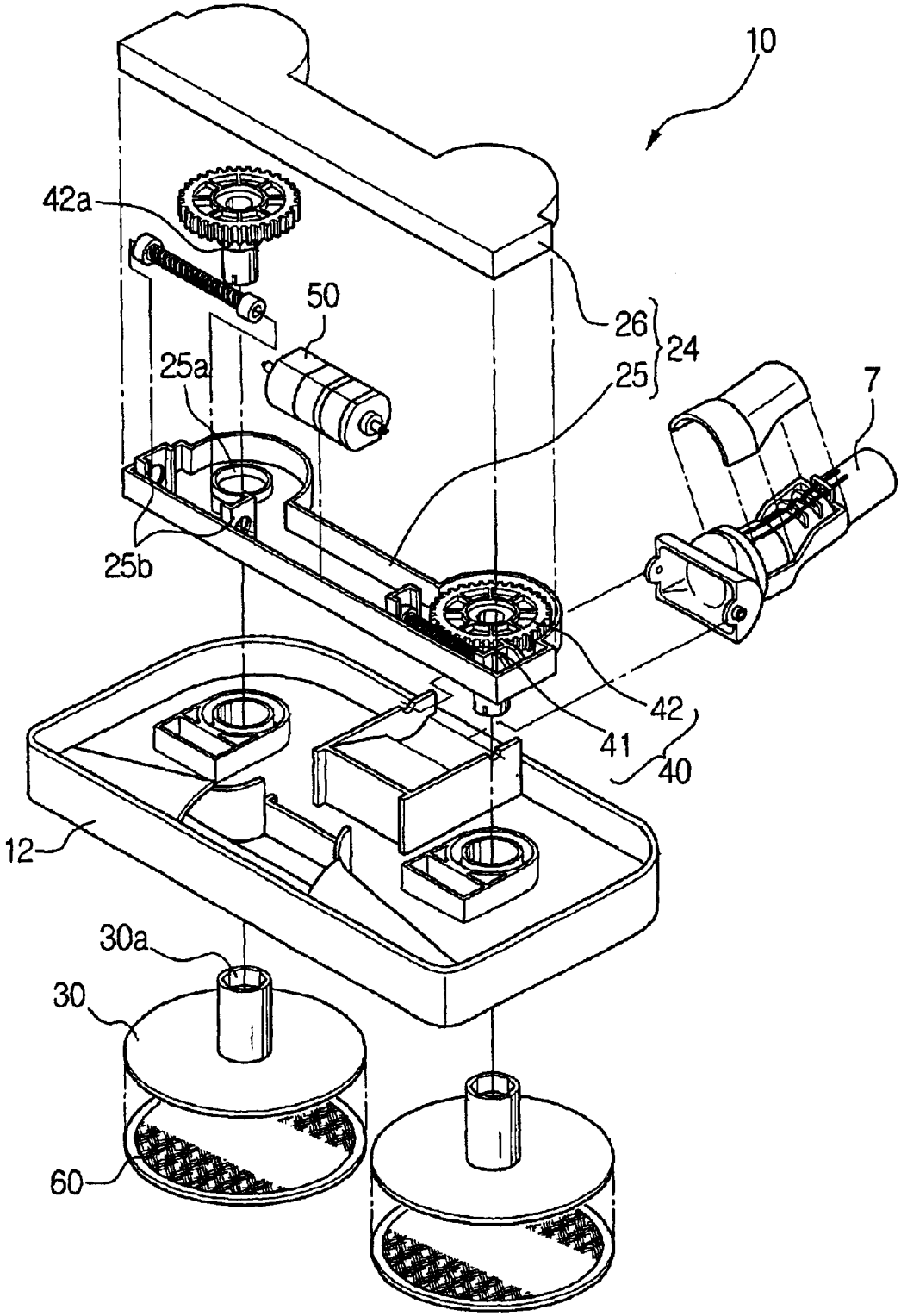
FIG. 8 is an exploded perspective view showing the rotatably floor cloth driving apparatus according to a fourth preferred embodiment of the present invention.

FIG. 8 shows the suction assembly 10 of the vacuum cleaner according to the fourth preferred embodiment of the present invention. According to the fourth preferred embodiment, the rotatable floor cloth driving apparatus of the vacuum cleaner includes a rotary driving means having a bi-directional rotary motor 50 and a power transmission unit 40. The rotary driving means is protected by a casing member 24 that is separately disposed in the suction assembly 10 for screening the rotary driving means from an air path connecting the suction assembly 10 and the connecting pipe 7.

As shown in FIG. 8, the power transmission unit 40 having the worm gear members 41 and the transmission gears 42, and the rotary driving means having the bi-directional rotary motor 50 are enclosed in an upper casing 26 and a lower casing 25.

Also, as shown in FIG. 8, the lower casing 25 has an opening 25*a* through which the transmission gears 42 are connected to the rotary members 30, and a plurality of fixing brackets 25*b* as a mounting means that rotatably support both ends of the worm gear members 41, respectively.

The upper casing 26 is connected to the upper portion of the lower casing 25, thereby screening the rotary driving means that is mounted on the lower casing 25 from the outside.

Further, it is preferable that the transmission gears 42 have connecting protrusions 42*a* protruding from the lower sides of the transmission gears 42 corresponding to the connecting holes 30*a* formed in the rotary members 30, for connecting the transmission gears 42 to the rotary members 30.

As shown in FIG. 8, the connecting protrusions 42*a* and the connecting holes 30*a* are shaped to have a non-circular cross-section. Accordingly, when the transmission gears 42 are connected to the rotary members 30, the power is transmitted from the transmission gears 42 to the rotary bodies 30 with the least power loss. In this embodiment, the section of the connecting holes 30*a* and the connecting protrusions 42*a* is octagonal.

Further, for transmitting the power from the rotary motor 50 to the worm gear members 41, the worm gear members 41 and the rotary motor 50 can be connected with each other in a key way. Here, the detailed description will be omitted since the same is described earlier in the previous embodiments.

According to the rotatable floor cloth driving apparatus constructed as above, the rotary driving means is screened from the air path through which the air is passed, and is sealed. Accordingly, malfunction of the power transmission unit 40 or the bi-directional rotary motor 50 of the rotary driving means, which is caused by the impurities or foreign substances in the air, can be minimized. As a result, the durability of the rotary driving means is enhanced.

Figure 9:
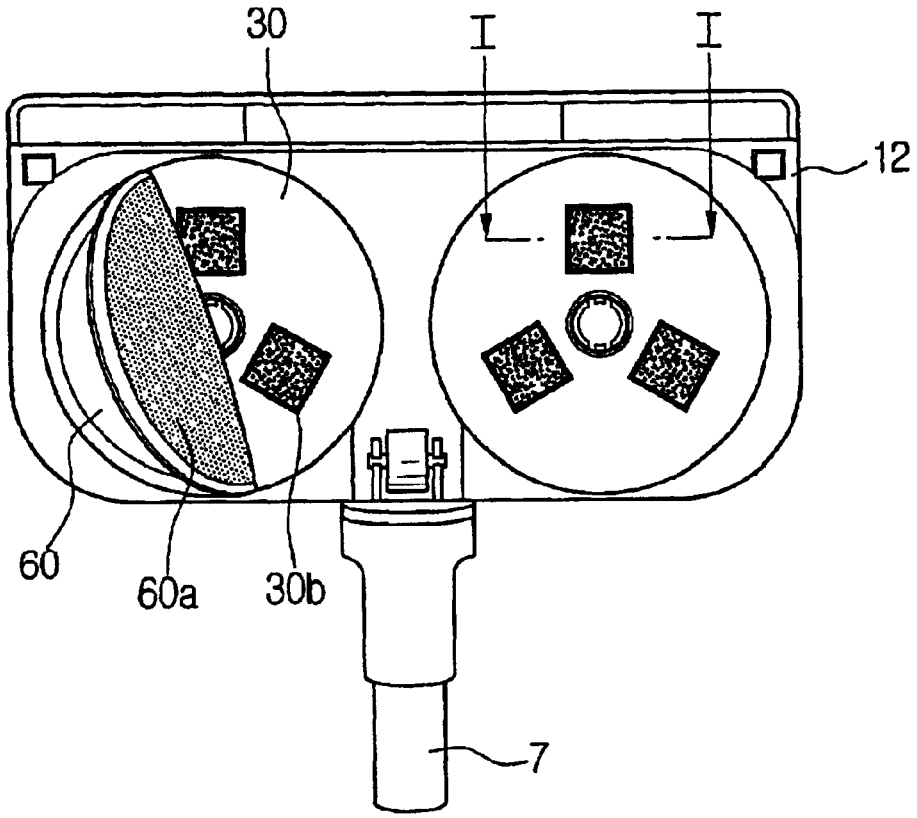
FIG. 9 is a bottom view showing the suction assembly of the vacuum cleaner according to a fifth preferred embodiment of the present invention.
Figure 10:
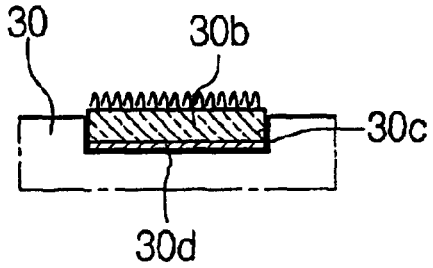
FIG. 10 is an enlarged sectional view taken on line I—I of FIG. 9.

FIGS. 9 and 10 are views for explaining the rotary members 30 of the rotatable floor cloth driving apparatus according to the fifth preferred embodiment of the present invention. According to the fifth preferred embodiment of the present invention, Velcro fasteners 30*b* as a removable means are seated on a plurality of recesses 30*c* that are formed on lower surfaces of the rotary members 30 around the center of rotation at a uniform distance from each other.

Here, the Velcro fasteners 30*b* are seated on the lower surfaces of the rotary members 30 around the center of rotation at a uniform angle (120°) from each other. Although it is preferable that the section of the Velcro fasteners 30*b* is square, it is not strictly limited thereto.

Further, the Velcro fasteners 30*b* are attached to the recesses 30*c* by an adhering means 30*d*, and in this embodiment, the adhering means 30*d* includes a double-sided sticker. In addition to the double-sided stickers, the adhering means 30*d* can use any proper ways that are well known in the art.

According to the rotary members 30 constructed above, since the contact area between the floor clothes 60 and the rotary members 30 is increased, the binding force between the floor clothes 60 and the rotary members 30 is increased.

Accordingly, the cleaning efficiency is improved. Also, by seating the removable means 30*b* on the recesses 30*c*, attachment or removal of the floor clothes 60 becomes easier.

Figure 11:
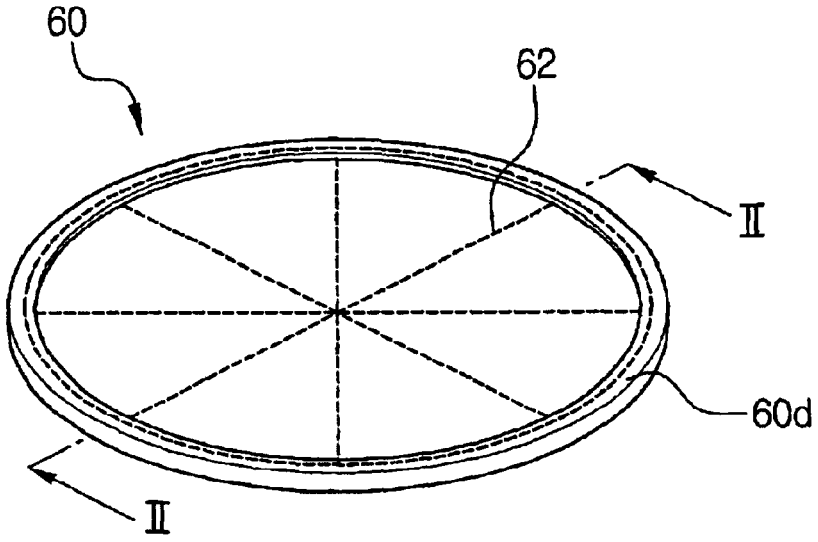
FIG. 11 is a schematic perspective view of a floor cloth shown in FIG. 9.
Figure 12:
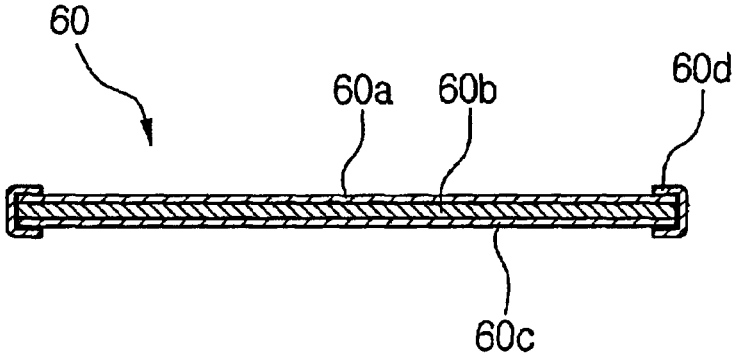
FIG. 12 is a sectional view taken on line II—II of FIG. 11.

Meanwhile, as shown in FIGS. 11 and 12, the floor clothes 60 are removably employed on the lower ends of the suction assembly of the vacuum cleaner, for cleaning the impurities of the cleaning surfaces. Each floor cloth 60 includes a body 60*c* contacting the cleaning surface, and a removable layer 60*a* attached to the upper surface of the body 60*c* and supported by the binding force with the removable means formed on the mounting portion such as rotary member 30. It is preferable that the floor cloth 60 is shaped to correspond to the rotary members 30 the floor cloth 60 is attached to, and in this embodiment, the floor cloth 60 is formed to have circular shape.

The body 60*c* of the floor cloth 60 contact the cleaning surface during cleaning process, and is made of a fabric that is usually used for mopping the floor.

Here, the floor cloth 60 includes a supporting means for enhancing cleaning efficiency by preventing deformation of the body 60*c* in a contact with the cleaning surface and also enabling efficient contact with the cleaning surface. The supporting means is disposed between the body 60*c* and the removable layer 60*a*, and includes a supporting member 60*b* for elastically returning the body 60*c* to an original shape. Here, it is preferable that the supporting member 60*b* is made of porous material such as a sponge, which would absorbed liquid during wet cleaning on the cleaning surface.

Here, the body 60*c* and the removable layer 60*a* are sewed by sewing thread 62, while the outer circumference of the floor cloth 60 is covered by a protective member 60*d* for preventing fluffing of the fabric floor cloth 60.

Figure 13:
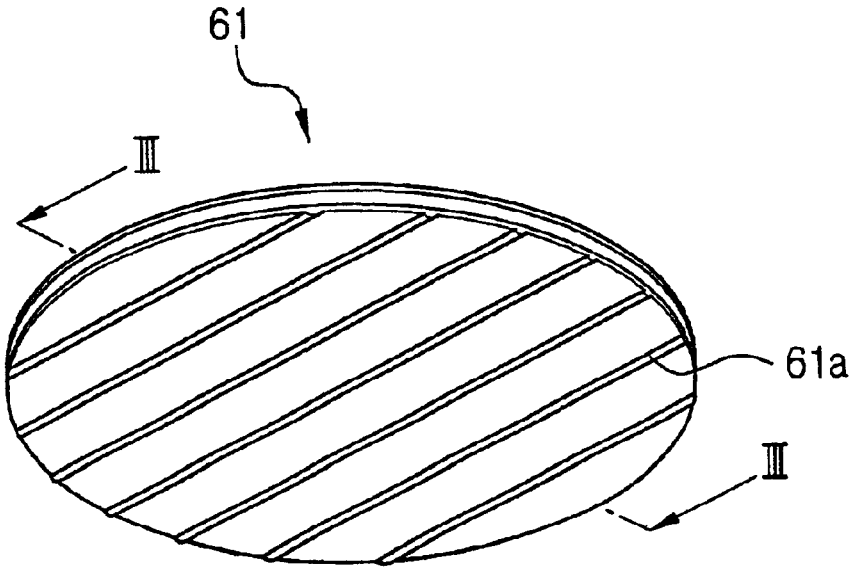
FIG. 13 is a rear perspective view schematically showing a floor cloth of the rotatable floor cloth driving apparatus of the vacuum cleaner according to a sixth preferred embodiment of the present invention.
Figure 14:
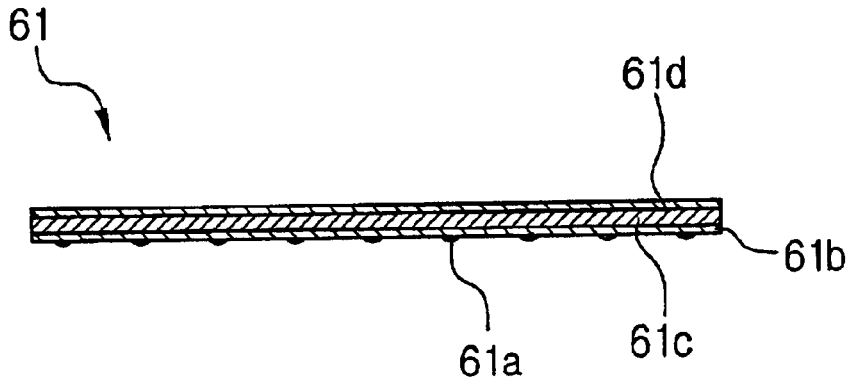
FIG. 14 is a sectional view taken on line III—III of FIG. 13.

FIGS. 13 and 14 are views for explaining a floor cloth 61 for use in a vacuum cleaner according to the sixth preferred embodiment of the present invention. The floor cloth 61 includes a body 61*b*, a removable layer 61*d*, and a supporting means for enhancing the cleaning efficiency by preventing deformation of the body 61*b* and enabling easy contact with the cleaning surface. The supporting means includes a supporting member 61*c* inserted between the body 61*b* and the removable layer 61*d*, and a protruding pattern protruding from the lower surface of the body 61*c* that contacts the cleaning surface in a predetermined pattern.

Here, as shown in FIG. 13, the protruding pattern includes a plurality of protruding lines 61*a* protruding from the lower surface of the body 61*c* that contacts the cleaning surface in a linear pattern. It is preferable that the protruding lines 61*a* are made of the fabric identical to the fabric of the body 61*c*.

It is also preferable that the body 61*b*, the removable layer 61*d*, and the supporting member 61*c* are attached to each other by adhesives such as bond, or the like.

According to the floor cloth 61 constructed as above, due to the protruding lines 61*a* protruding from the surface of the floor cloth 61 attached to the lower end of the suction assembly 10, the old dirt on the cleaning surface can be efficiently floor mopped out.

The operation of the present invention will be described in greater detail with reference to the accompanying drawings.

First, by manipulating the driving switch 6 (see FIG. 1) formed on the handle portion 5, the fan motor of the cleaner body is driven, and accordingly, the dust collecting chamber is subject to the negative pressure with respect to outer atmosphere. Due to the negative pressure, the external air is drawn into the cleaner body together with dust and impurities piled on the cleaning surface in a direction indicated by a solid arrow of FIG. 4. Simultaneously, as the driving switch 6 is manipulated, power is supplied through the power terminal 21 and the power conductor 22 to the rotary motor 50. Accordingly, the rotary motor 50 is driven. Then the pair of rotary shaft portions 50*a* connected to the rotary motor 50 are simultaneously rotated. Accordingly, the worm gear members 41 and 41' connected to the rotary shaft portions 50*a* are rotated in the same direction as the rotational direction of the rotary shaft portions 50*a*. Then the transmission gears 42 meshed with the worm gear members 41 and 41' are rotated in the direction perpendicular with respect to the rotational direction of the worm gear members 41 and 41', respectively.

Since the transmission gears 42 are connected to the rotary members 30 mounted on the lower end of the suction port body 12, the rotational force is transmitted from the transmission gears 42 to the pair of rotary members 30 that are connected to the transmission gears 42. Accordingly, the rotary members 30 are rotated in the same direction as the transmission gears 42 are rotated.

The floor clothes 60 are attached onto the lower ends of the rotary members 30 by the removable means 30*a* and 30*b*. Accordingly, the floor clothes 60 mounted on the lower ends of the rotary members 30 are rotated together with the rotary members 30. Then, by contacting the rotated floor clothes 60 against the floor, the impurities or old dirt on the corresponding floor are removed as the floor clothes 60 are rotated.

As described above, according to the present invention, by mounting the floor clothes 60 and 61 on the suction assembly of the vacuum cleaner, and rotating the floor clothes 60 and 61 at a high speed according to the rotational driving of the rotary driving means, while the dust is removed by the vacuum suction of the vacuum cleaner, the impurities or old dirt stuck on the floor can also be removed. Accordingly, cleaning efficiency is improved.

Although the preferred embodiments of the present invention have been described, it will be understood by those skilled in the art that the present invention should not be limited to the described preferred embodiments, but various changes and modifications can be made within the spirit and scope of the present invention as defined by the appended claims.

What is claimed is:

1. A vacuum cleaner comprising:

a suction assembly;

a dust collecting chamber collecting air and dust through an air path, wherein the air path connects the suction assembly to a connecting pipe by a negative pressure;

a driving portion generating the negative pressure and activated by manipulating a driving switch disposed on a handle portion;

a floor cloth rotatably driven in the suction assembly to clean a cleaning surface, the floor cloth arranged in a plane;

a rotary member rotatably disposed on a lower end of the suction assembly, for supporting the floor cloth, wherein the floor cloth rotates in a plane substantially parallel to the cleaning surface and the plane of the floor cloth;

rotary driving means controlled by the manipulation of the driving switch, for supplying a driving force to rotate the rotary member;

power supplying means for supplying an electric signal generated by the manipulation of the driving switch to the rotary driving means; and wherein the rotary driving means includes a bi-directional rotary motor having a air of rotary shaft portions;

one of the air of rotary shaft portions being formed on each side of the rotary motor and simultaneously rotating with each other by the power supplied from the power supply means; and the rotary shaft portions connecting to a power transmission unit for transmitting a driving force of the rotary shaft portions to the rotary member.

2. The apparatus of claim 1, wherein the power supplying means is disposed on the connecting pipe that is protected from the air path by a protective cover and includes a power terminal electrically connected to the driving switch of the handle portion, and a power conductor for electrically connecting the power terminal to the rotary driving means.

3. The apparatus of claim 1, wherein the power transmission unit includes a pair of worm gear members connected to the rotary shaft portions for rotation in the same direction as the rotary shaft portions rotate; and transmission gears meshed with the pair of worm gear members for converting a rotational force in the direction the worm gear members rotate into a rotational force in a direction perpendicular to the rotational direction of the worm gear members and transmitting the converted rotational force to the rotary member.

4. The apparatus of claim 3, wherein the worm gear members are connected to the rotary shaft portions by joint connecting members, respectively.

5. The apparatus of claim 3, wherein the worm gear members have threads formed on outer circumferences thereof in an opposite direction from each other, for rotation in the opposite direction when the transmission gears are rotated.

6. The apparatus of claim 1, wherein the power transmission unit includes transmission gears connected to the rotary member; and a worm gear member having a worm gear portion formed on an outer circumference of the worm gear member for being meshed with the transmission gears, and a key portion formed on one end of the worm gear member for being connected to one of the pair of rotary shaft portions of the rotary driving means in a keyway.

7. The apparatus of claim 6, wherein either the key portion of one of the pair of rotary shaft portions has a key groove having a non-circular section formed on one end, while either the key portion of one of the pair of rotary shaft portions without the key groove has a key portion that is formed on one end having corresponding shape to the key groove.

8. The apparatus of claim 6, wherein the worm gear member has threads formed on the outer circumference in an opposite direction so that the transmission gears can be rotated in the opposite direction.

9. The apparatus of claim 1, wherein the power transmission unit includes transmission gears connected to the rotary member; and a worm gear member having a worm gear portion formed on an outer circumference of the worm gear member for being meshed with the transmission gears, and a connecting portion formed on one end of the worm gear member for being screwed to one of the pair of rotary shaft portions of the rotary driving means.

10. The apparatus of claim 9, wherein one of the connecting portion and the rotary shaft portions has a male thread formed on the outer circumference, while one of the connecting portion and the rotary shaft portion without the male thread has a female thread formed on the end corresponding to the male thread.

11. The apparatus of claim 10, wherein the male thread and the female thread formed on the connecting portion and the rotary shaft portions are left-hand threads for screw-fastening when the rotary shaft portions are rotated on the rotary motor in a clockwise direction.

12. The apparatus of claim 10, wherein the male thread and the female thread formed on the connecting portion and the rotary shaft portions are right-hand threads for screw-fastening when the rotary shaft portions are rotated on the rotary motor in a counterclockwise direction.

13. The apparatus of claim 10, wherein the male thread and the female thread on the outer circumference of the worm gear member is formed in an opposite direction so that the transmission gears are rotated in the opposite direction.

14. The apparatus of claim 1, further comprising a casing member formed in the suction assembly for enclosing the rotary driving means, thereby screening the rotary driving means from the air path of the suction assembly.

15. The apparatus of claim 14, wherein the casing member has a lower casing having openings formed on a bottom through which the power transmission unit is directly connected to the rotary member and a plurality of fixing means for rotatably supporting the power transmission unit; and an upper casing connected to an upper portion of the lower casing for screening the rotary driving means mounted on the lower casing from the outside.

16. The apparatus of claim 1, further comprising removable means for removably supporting the floor cloth onto the rotary members.

17. The apparatus of claim 16, wherein the removable means includes at least one hook and loop fastener disposed on a lower surface of the rotary member in a predetermined pattern.

18. The apparatus of claim 17, wherein the hook and loop fastener is seated on a plurality of recesses formed on the lower surface of the rotary member around a center of rotation at a uniform distance from each other.

19. The apparatus of claim 17, wherein the hook and loop fastener is disposed on the lower surface of the rotary member around the center of rotation at an angular spacing of 120°.

20. The apparatus of claim 1 wherein the plane of the floor cloth is arranged to be substantially entirely in contact with the cleaning surface.

* * * * *